US005111509A

United States Patent [19]

Takeuchi et al.

[11] Patent Number: 5,111,509

[45] Date of Patent: May 5, 1992

[54] ELECTRIC ACOUSTIC CONVERTER

[75] Inventors: Akihiko Takeuchi; Shigeo Suzuki, both of Shizuoka, Japan

[73] Assignee: Yamaha Corporation, Japan

[21] Appl. No.: 288,028

[22] Filed: Dec. 21, 1988

[30] Foreign Application Priority Data

Dec. 25, 1987 [JP] Japan ..... 62-332959
Jan. 14, 1988 [JP] Japan ..... 63-7280
Feb. 25, 1988 [JP] Japan ..... 63-44720

[51] Int. Cl.[5] ..... H04R 25/00

[52] U.S. Cl. ..... 381/154; 381/159; 381/90; 381/188; 381/205; 181/160

[58] Field of Search ..... 381/159, 153, 154, 156, 381/158, 161, 182, 87, 88, 89, 90, 188, 205; 181/160, 156

[56] References Cited

U.S. PATENT DOCUMENTS

| | | | |
|---|---|---|---|
| Re. 31,679 | 9/1984 | Froeschle et al. | 181/156 |
| 1,814,554 | 7/1931 | Hutchison | 181/160 |
| 1,823,705 | 9/1931 | Smith | 181/160 |
| 1,969,704 | 8/1934 | D'Alton | 181/160 |
| 2,193,399 | 3/1940 | Fisher | 181/160 |
| 2,228,866 | 1/1941 | Olson | 381/158 |
| 2,739,659 | 3/1956 | Daniels | 381/153 |
| 2,896,737 | 7/1959 | Gellman | 181/153 |
| 2,905,259 | 9/1959 | Ashe | 281/158 |
| 3,327,808 | 6/1967 | Shaper | 181/156 |
| 3,393,766 | 7/1968 | Mitchell | 181/153 |
| 4,930,596 | 6/1990 | Saiki et al. | 181/156 |

FOREIGN PATENT DOCUMENTS

| | | | |
|---|---|---|---|
| 63-31400 | 12/1988 | Japan | 381/154 |

*Primary Examiner*—Forester W. Isen
*Attorney, Agent, or Firm*—Lerner, David, Littenberg, Krumholz & Mentlik

[57] ABSTRACT

In the construction of an electric acoustic converter such as a speaker for musical instruments, a tone generating unit arranged near one open end of a resonant tube is accompanied with a partition which has a central through hole and extends across the longitudinal hole of the resonant tube. For complicated modes of resonance and rich acoustic vibration, two or more resonant tubes of different types may be used in combination with one or more tone generating units. Presence of such a partition clearly defines the length of the resonant air columns to be produced in the resonant tube and such clear-cut resonant air columns bring about high resonance sharpness.

15 Claims, 6 Drawing Sheets

ELECTRIC ACOUSTIC CONVERTER

BACKGROUND OF THE INVENTION

The present invention relates to an electric acoustic converter, and more particularly relates to improvement in the tone generating function of an electric acoustic converter such as a speaker generally used for resonance on musical instruments.

A horn-type speaker for vehicles is a typical example of such an electric acoustic converter in which sound waves generated by a vibratory membrane are emanated outside through a horn. (see "Musical Engineering" by Harry F. Olson, McGraw-Hill Book Company, Inc. P183 FIG. 5.77, and P320 FIG. 9, 10) The horn-type speaker is generally provided with vibratory membrane, a horn and an electromagnetic driver unit for the vibratory membrane. The driver unit includes an electromagnet, an armature mechanically connected to the vibratory membrane and a shifter interposed between the electromagnet and a power source. When the electromagnet is not energized, the shifter is spring loaded to be in contact with the armature. When the electromagnet is energized, the same attracts the armature out of contact with the shifter and the electromagnet is disconnected from the power source. Thereupon the armature resumes the original position due to elastic recovery of the vibratory membrane and comes in contact with the shifter again. This process is repeated cyclically for emanation of sound waves through the horn.

This cyclic process is repeated with a resonant frequency fixed by the combination of the vibratory membrane, the armature and the horn. Inasmuch as the driving force acting upon the armature has a complicated wave shape, tones generated by the vibratory membrane are rich in harmonic tones. Under this condition, the resonance characteristics of the horn are quite influential on the tone quality. For generation of comfortable tones, a horn should preferably have a narrow throat maturing into a flare having a soft divergence. A horn having such a configuration is very close in mode of harmonic tone generation to natural musical instruments.

Such a conventional horn-type speaker, however, has a very even sound pressure distribution with respect to frequency (frequency characteristics) and its quality factor (Q) is rather small. As is well known, a small quality factor (Q) leads to low resonance sharpness and, as a consequence, tones generated become very close to those generated by electric and electronic musical instruments.

SUMMARY OF THE INVENTION

It is the object of the present invention to provide an electric acoustic converter generative of tones very close in quality factor (Q) to those generated by natural musical instruments.

In accordance with the basic aspect of the present invention, at least one tone generating unit arranged in a housing has a vibratory membrane, at least one resonant tube is arranged in communication with the interior of the housing, a partition provided with a through hole is arranged in the resonant tube facing the tone generating unit and the partition extends substantially normal to the axis of the resonant tube.

DESCRIPTION OF THE PREFERRED EMBODIMENTS

Figure 1:
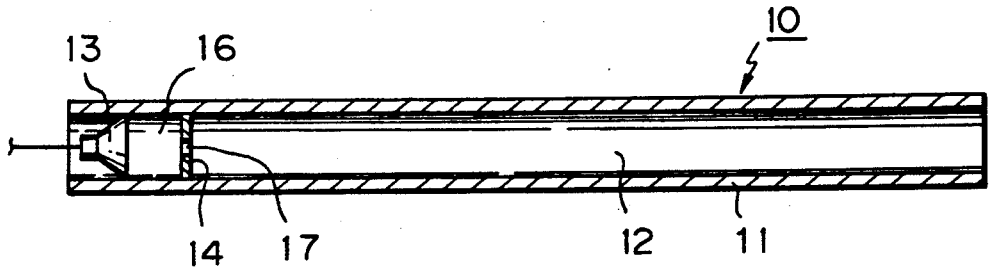
FIG. 1 is a sectional side view of the first embodiment of the present invention.

In the following description, like elements in different embodiments are indicated with like reference numerals.

The first embodiment of the converter in accordance with the present invention is shown in FIG. 1. The converter 10 includes a resonant tube 11 having a longitudinal hole 12 and a tone generating unit 13 arranged in the resonant tube 11 near one open end of the longitudinal hole 12. The other open end of the longitudinal hole 12 is for tone emanation. The tone generating unit 13 is of a known electric type provided with a vibratory membrane not shown. A partition 14 is fixed in the longitudinal hole 12 of the resonant tube 11 at a position near the tone generating unit 12. Thus a space 16 of a selected volume is left between the tone generating unit 12 and the partition 14. Most preferably, the partition 14 extends substantially normal to the axis of the resonant tube 11.

The partition 14 is made of, for example, soft iron of a selected thickness and is provided about its center with a through hole 17 for communication of the space 16 with the longitudinal hole 12. Preferably, the through hole 17 has a sound transverse cross section. The size of the through hole 17 is chosen properly in consideration of the size of the longitudinal hole 12.

In the operation of the converter 10, a sound wave generated by the vibratory membrane in the tone generating unit 13 enters the longitudinal hole 12 via the through hole 17 in the partition 14 to form a constant wave in the longitudinal hole 12. During this process, the sound wave is repeatedly reflected within the longitudinal hole 12 in the area between the partition 14 and the tone emanation end of the resonant tube 11. Thus a clear-cut resonant air column of a selected resonance frequency is formed within the resonant tube 11 for emanation of a tone of a large quality factor (Q). Here, the partition 14 operates as a sort of reflector plate in the longitudinal hole 12. Since the resonant tube 11 has a uniform transverse cross section over its entire length, clear resonance can be obtained for odd number harmonic tones. Better acoustic effect could be obtained when the tone generating unit 13 generates a tone of a tonal pitch corresponding to the resonance frequency of the resonant air column.

Several converters 10 may be used in combination in accordance with the number of the tonal pitches of tones to be generated. In this case, different converters have resonant tubes of different resonance frequencies and tone generating units of different tonal pitches. For example, such a combination is well usable for a pipe organ. Its spector energy distribution has a highly cyclic pattern, its formant is very clear and differences in tonal pitch are quite perceptible and, as a consequence, sharply discernible. When the peaks of respective tones are separated from each other beyond the critical band width, i.e. a difference in frequency which enables the difference between two different tones to be discerned, increased subjective loudness can be obtained for sharper discernment. Preferably, the cyclic trend of the spector energy distribution should be strongly developed in a frequency range predominant in perception of tonal pitches. Such a frequency range is generally from 500 to 2000 Hz.

Figure 2:
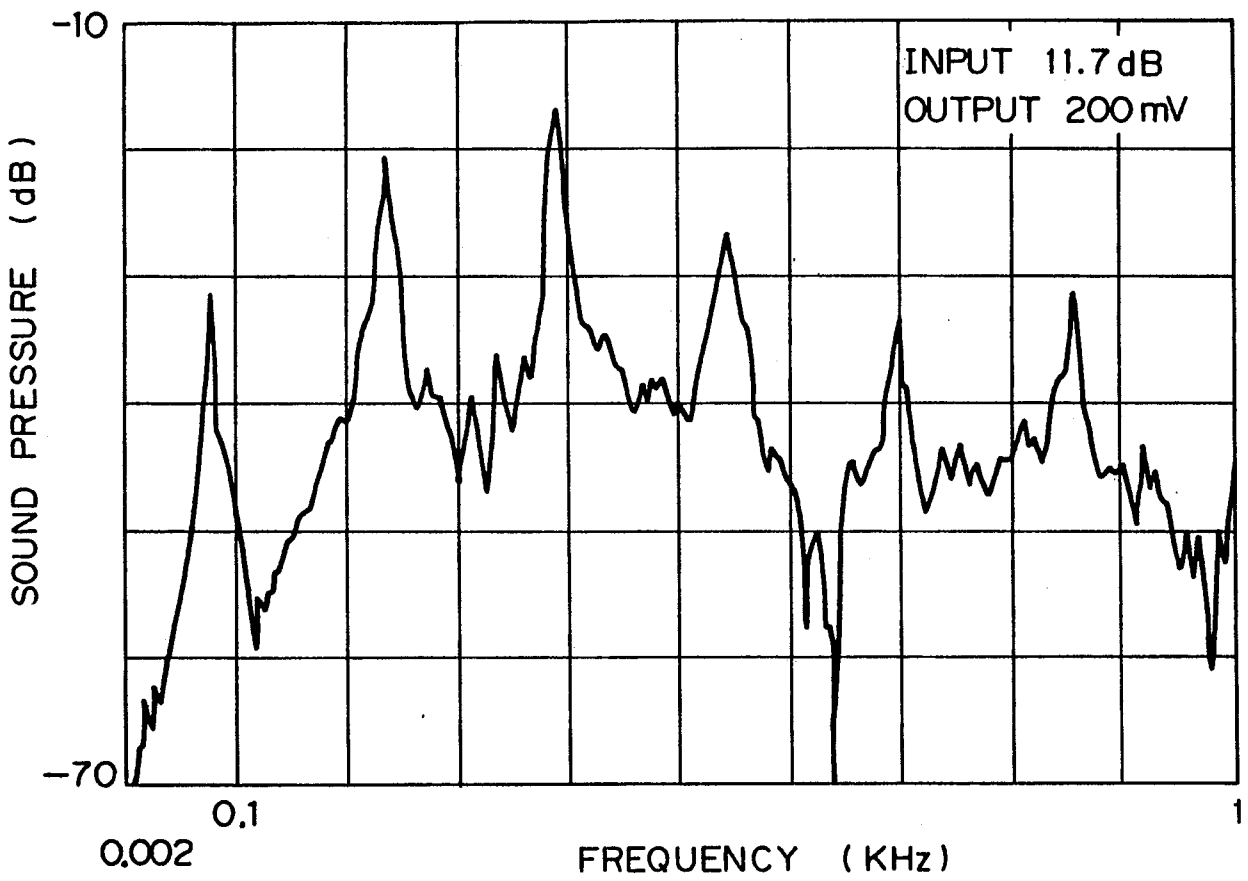
FIG. 2 is a graph for showing the relationship between frequency and output sound pressure of tones generated by the first embodiment of the converter in accordance with the present invention.
Figure 3:
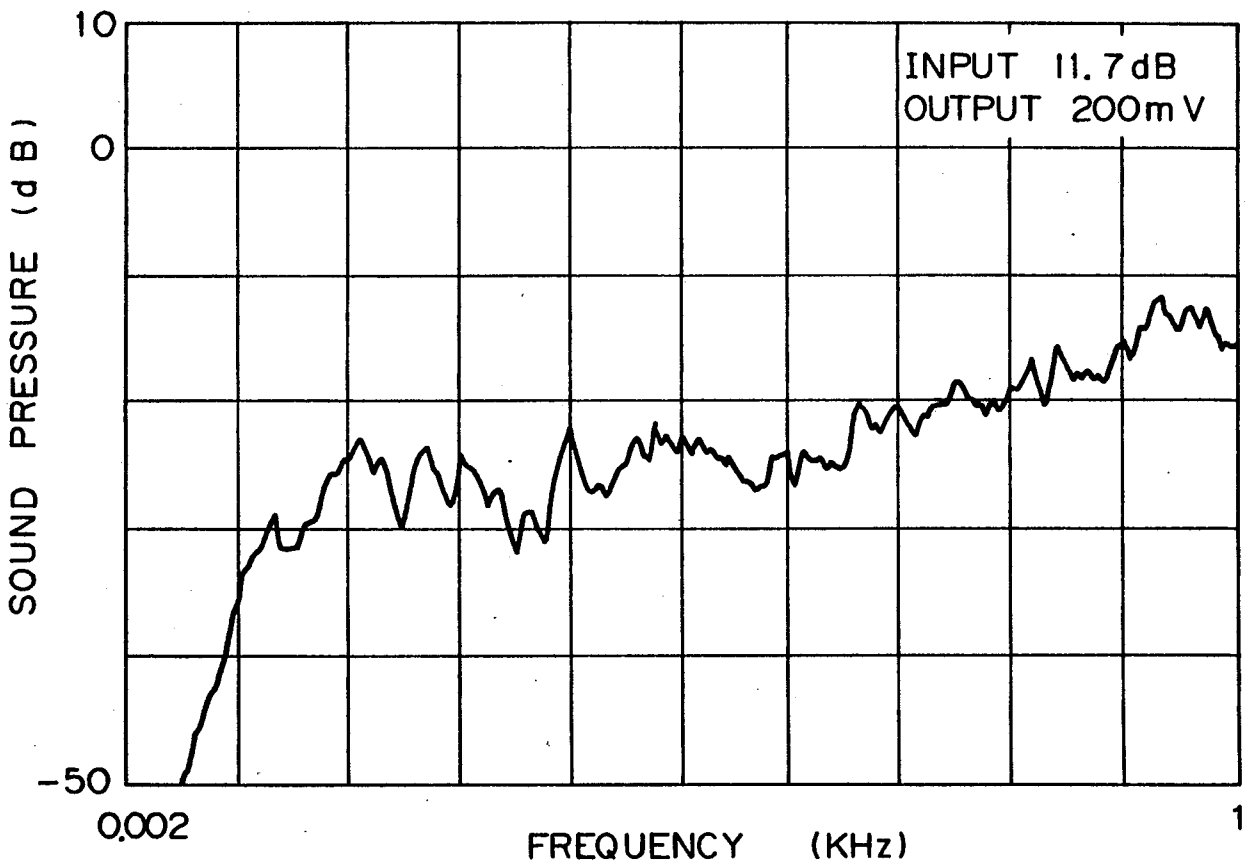
FIG. 3 is a graph for showing the relationship between frequency and output sound pressure of tones generated by a conventional horn-type speaker for vehicles.

FIG. 2 shows the relationship between frequency and output sound pressure for tones generated by the converter 10 of this embodiment. In the drawing, the frequency in KHz is taken on the abscissa and the sound pressure in dB is take on the ordinate. For comparison, the relationship between frequency and output sound pressure for tones generated by the above-describe conventional horn-type speaker is shown in FIG. 3. By comparison of the two experimental data, it is clearly confirmed that the quality factor (Q) can be significantly increased by application of the present invention.

Figure 4:
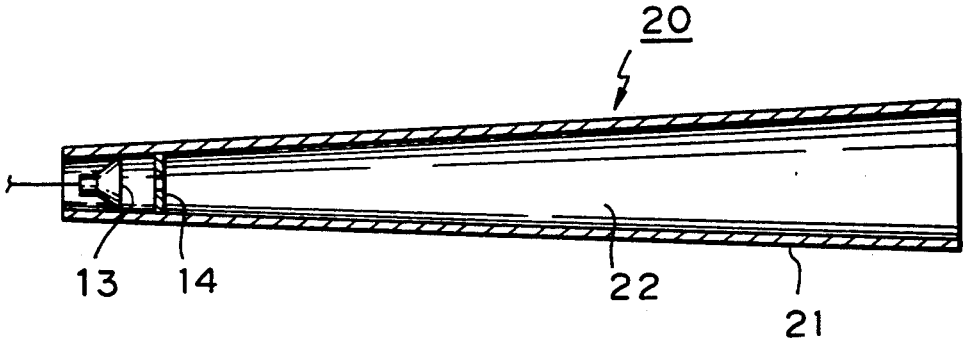
FIG. 4 is a sectional side view of the second embodiment of the present invention.

The second embodiment of the converter in accordance with the present invention is shown in FIG. 4. Like the first embodiment, the converter 20 includes a resonant tube 21 having a longitudinal hole 22, a tone generating unit 13 arranged in the resonant tube 21 and a partition 14 with a central through hole 17 arranged in the longitudinal hole 22. In the case of this embodiment, the resonant tube 21 is funnel-shaped and the longitudinal hole 22 enlarges its transverse cross section on the side of its tone emanation end. Since the resonant tube 21 has a diverging transverse cross section along its length, clear resonance in this case can be obtained for even number harmonic tones.

Figure 5:
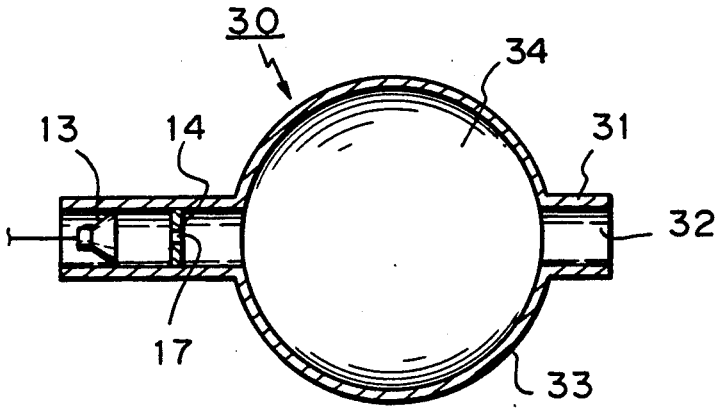
FIG. 5 is a sectional side view of the third embodiment of the present invention.

The third embodiment of the converter in accordance with the present invention is shown in FIG. 5. Like the first embodiment, the converter 30 includes a resonant tube 31 having a longitudinal hole 32, a tone generating unit arranged in the resonant tube 31 near one open end of the longitudinal hole 32 and a partition 14 with a through hole 17 arranged in the longitudinal hole 32. In the area between the partition 14 and the other open end of the longitudinal hole 32, the resonant tube 31 is provided with a spherical bulge 33 which internally defines a Helmholtz resonant chamber 34 in communication with the longitudinal hole 32. Provision of the Helmholtz resonant chamber 34 further increases the quality factor (Q) of tones generated.

In a modification of the embodiment shown in FIG. 1 or 5, the resonant tube 11 or 31 may be constructed with a length that is adjustable depending on the ambient temperature. A proper telescopic construction may be employed to this end.

In the case of the foregoing embodiments, the tone generating unit and the partition are incorporated into the resonant tube after separate preparation. This incorporation requires a complicated operation. Further, the position of the partition is fixed in the longitudinal hole of the resonant tube and not easily changeable in accordance with a change in ambient temperature. The fourth embodiment of the converter in accordance with the present invention shown in FIGS. 6 to 8 is proposed to remove the above-described inconveniences.

Figure 6:
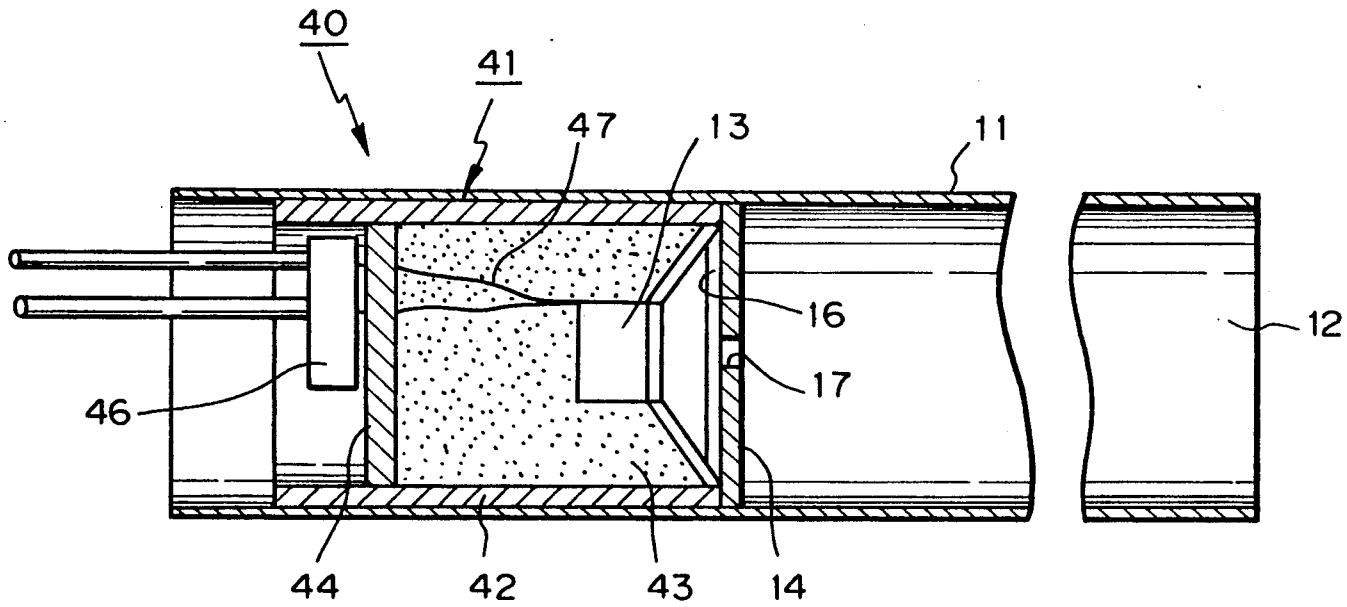
FIG. 6 is an enlarged sectional side view of the fourth embodiment of the present invention.

In FIG. 6, a converter 40 includes a resonant tube 11 having a longitudinal hole 12 and a tone generating assembly 41 arranged in the resonant tube 11 near one open end of the longitudinal hole 12. A partition 14 having a central through hole 17 is also arranged in the longitudinal hole 12 facing the tone generating assembly 41.

The tone generating assembly 41 includes a cylindrical housing 42 tightly inserted into the resonant tube 11. Near one end, the cylindrical housing 42 is accompanied via a lid 44 with a box 46 encasing an electric circuit and its accessories. The other end of the cylindrical housing 42 is closed by the partition 14 in the longitudinal hole 12. A tone generating unit 13 is arranged within the cylindrical housing 42 whilst leaving a space 16 between itself and the partition 14. The space between the lid 44 and the tone generating unit 13 is filled with a sound absorber 43 made of rock wool or glass wool. The tone generating unit 13 is connected through the sound absorber 43 to the electric circuit in box 46 by means of conductors 47.

Figure 7:
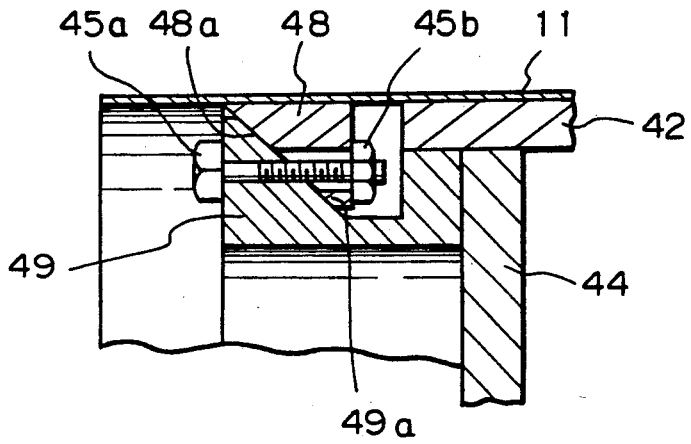
FIG. 7 is a fragmentary sectional side view of a tone generating assembly used for the converter shown in FIG. 6.
Figure 8:
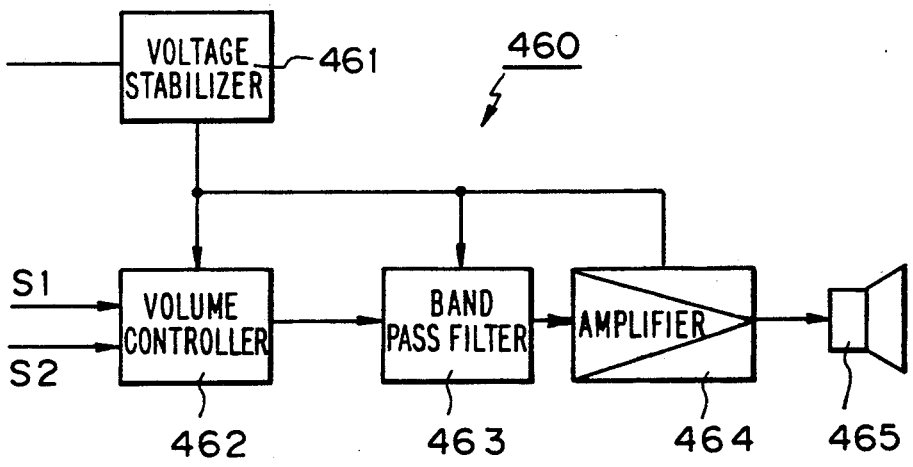
FIG. 8 is a block diagram of an electric circuit used for the tone generating assembly shown in FIG. 6.

The cylindrical housing 42 of the tone generating assembly 41 is fixed to the resonant tube 11 preferably in a manner shown in FIG. 7. A positioning piece 48 having a tapered face **48*a* is fixed to the inner wall of the resonant tube 11 and a ring 49 is fixed to the cylindrical housing 42 and the lid 44. The ring 49 has an annular tapered face 49*a* engageable with the tapered face 48*a* on the positioning piece 48. The ring 49 is also fixed to the positioning piece 48 by means of fasteners 45*a* and 45*b* idly inserted through the positioning piece 48. Depending on the extent of fastening by the fasteners 45*a* and 45*b*, the ring 49 changes its diameter and moves in the axial direction of the resonant tube 11 with the entire tone generating assembly 41 due to sliding between the tapered faces 48*a* and 49*a*. Needless to say, the partition 14 attached to the cylindrical housing 42 follows this axial movement in the longitudinal hole 12 of the resonant tube 11**.

In the case of this embodiment, the partition 14 is combined in one body with the tone generating assembly 41 including the tone generating unit 13. As a consequence, the partition 14 and the tone generating unit 13 can be mounted to the resonant tube 11 quite concurrently, thereby greatly simplifying assembly of the converter 40. In addition, the position of the partition 14 can be adjusted very subtly in accordance with changes in ambient temperature when the tone generating assembly 41 is displaceably attached to the resonant tube 11 as shown in FIG. 7.

One example of the electric circuit contained in the box 46 is shown in FIG. 8, in which the electric circuit 460 includes a voltage stabilizer 461 connected to a given constant voltage source (not shown). The voltage stabilizer 461 supplies a stabilized constant voltage to a volume controller 462, a band pass filter 463 and an amplifier 464 connected to each other in the described order. The volume controller 462 is receptive of acoustic signals such as a tone volume control signal S1 and a wave shape signal from a proper outside system. On receipt of such acoustic signals, the volume controller 462 passes a volume signal to a speaker 465 via the band pass filter 463 and the amplifier 464.

In the case of the foregoing embodiment, one converter is provided with one resonant tube combined with one partition only. As remarked above, the resonance frequency of the converter is dependent upon the length of the resonant tube and position of the partition. As a result, tones generated are rather simple in resonance and, as a consequence, poor in acoustic variation. Although the partition is more or less displaceable in the resonant tube in the case of the fourth embodiment shown in FIGS. 6 and 7, the extent of the displacement is not so significant as to appreciably influence the mode of resonance. The following embodiments are proposed to suffice such users' requirement for richer acoustic variation of tones.

Figure 9:
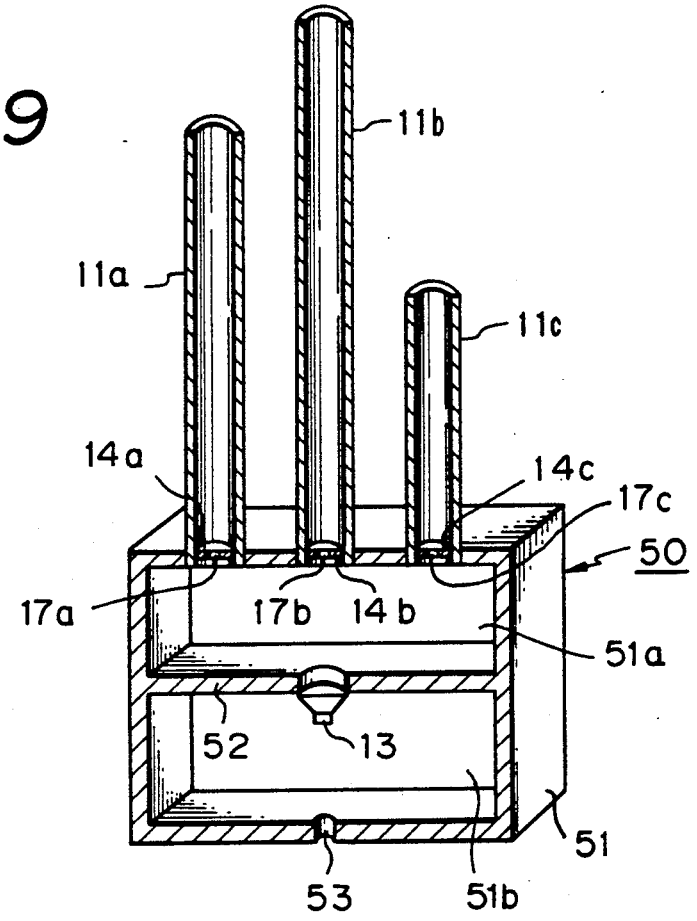
FIG. 9 is a sectional perspective view of the fifth embodiment of the present invention.

The fifth embodiment of the converter in accordance with the present invention is shown in FIG. 9, in which a converter 50 includes a hollow housing 51 internally divided into two chambers 51*a* and 51*b* by an intermediate wall 52. A tone generating unit 13 is fixed in a through hole in the wall 52 whilst facing the first chamber 51*a*. Three sets of resonant tubes 11*a* to 11*c* are mounted to the housing 51 opening into the first chamber 51*a*. These resonant tubes 11*a* to 11*c* are different in length and transversal size from each other so that resonant air columns formed therein should be different in mode from each other. In the case of the illustrated example, the second resonant tube 11*b* is longest and thickest while the third resonant tube 11*c* is shortest and thinnest.

Near the ends opening into the first chamber 51*a*, the resonant tubes 11*a* to 11*c* are provided with partitions 14*a* to 14*c* having through holes 17*a* to 17*c*. A through hole 53 is formed through the end wall of the second chamber 51*b* for pneumatic communication with the outside.

When a tone is generated by the tone generating unit 13, some of the resonant tubes 11*a* to 11*c* resonate in different modes and some of the resonant tubes 11*a* to 11*c* do not resonate. Thus, as the total, the converter 50 performs very complicated resonance and enriches acoustic variation of tones generated.

Figure 10:
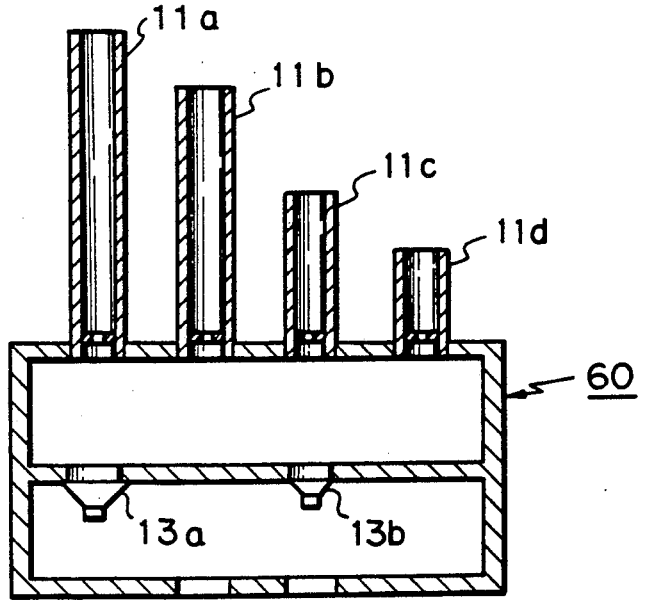
FIG. 10 is a sectional side view of the sixth embodiment of the present invention.

The sixth embodiment shown in FIG. 10 is a modification of the one shown in FIG. 9. The converter 60 is provided with four resonant tubes 11*a* to 11*d* and two tone generating units 13*a* and 13*b*. The increase in the number of the tone generating units further enriches acoustic variation.

We claim:

1. An electric acoustic convertor comprising, a housing, a plurality of tubes each defining a resonant chamber having a proximal end attached to said housing and a distal end, a plurality of tone generating units each having a main sound wave emanating face arranged in said housing and a vibratory member for generating sound waves, and a partition arranged in each of said resonant chambers between said plurality of tone generating units and said distal ends of said resonant chambers, each of said partitions having an aperture for passage of said sound waves from said main sound wave emanating face of one of said tone generating units to one of said resonant chambers.

2. An electric acoustic convertor as claimed in claim 1 wherein one of said resonant chambers has a first length and at least one other of said resonant chambers has a second length different than said first length.

3. An electric acoustic convertor as claimed in claim 1 wherein in one of said resonant chambers has a first transverse cross-section, and at least one other of said resonant chambers has a second transverse cross-section different from said first transverse cross-section.

4. An electric acoustic convertor as claimed in claim 1 wherein said partition in one of said resonant chambers is arranged at a first spaced distance from said plurality of tone generating units, and said partition in at least one other of said resonant chambers is arranged at a second spaced distance different from said first spaced distance.

5. An electric acoustic convertor comprising, a tube defining a resonant chamber having a proximal end and a distal end, a tone generating unit arranged in said proximal end and having a vibratory member for generating sound waves and a main sound wave emanating face, a partition arranged in said resonant chamber between said tone generating unit and said distal end, said partition having an aperture for passage of said sound waves from said main sound wave emanating face of said tone generating unit to said resonant chamber, said partition being integrally connected to said tone generating unit to form a tone generating assembly longitudinally displaceable along said resonant chamber, a ring fixedly connected to a longitudinal end of said tone generating assembly remote from said partition, said ring having a first tapered face, a positioning piece fixedly connected internally of said resonant chamber, said positioning piece having a second tapered face in surface contact with said first tapered face on said ring, and fastening means for detachably fastening said first and second tapered faces together, whereby adjustment of said fastening means causes longitudinal displacement of said tone generating assembly along said resonant chamber.

6. An electric acoustic converter, comprising a tube defining a resonant chamber having a proximal end and a distal end, a tone generating unit arranged in said proximal end and having a vibratory member for generating sound waves and a main sound wave emanating face, and a partition arranged in said resonant chamber between said tone generating unit and said distal end, said partition arranged at a spaced distance from said tone generating unit and having an aperture for passage of said sound waves from said main sound wave emanating face of said tone generating unit to said resonant chamber, said resonant chamber having a transverse cross-section which is substantially constant between said partition and said distal end.

7. An electric acoustic convertor comprising, a tube defining a resonant chamber having a proximal end and a distal end, a tone generating unit arranged in said proximal end and having a vibratory member for generating sound waves and a main sound wave emanating face, and a partition arranged in said resonant chamber between said tone generating unit and said distal end, said partition having an aperture for passage of said sound waves from said main sound wave emanating face of said tone generating unit to said resonant chamber, said resonant chamber including a first portion, a second portion and an intermediate portion arranged between said first and second portions, said first and second portions having substantially equal transverse cross-sections, and said intermediate portion having a transverse cross-section which is substantially larger than said transverse cross-sections of said first and second portions.

8. An electric acoustic convertor comprising, a housing, a tone generating unit having a main sound wave emanating face arranged in said housing and a vibratory member for generating sound waves, a plurality of tubes each defining a resonant chamber having a proximal end attached to said housing and a distal end, and a partition arranged in each of said resonant chambers between said tone generating unit and said distal ends of said resonant chambers, each of said partitions having an aperture for passage of said sound waves from said main sound wave emanating face of said tone generating unit to each of said resonant chambers, said partition in one of said resonant chambers being arranged at a first spaced distance from said tone generating unit, and said partition in at least one other of said resonant chambers being arranged at a second spaced distance different from said first spaced distance.

9. An electric acoustic converter comprising, a housing, a plurality of tone generating units each having a main sound wave emanating face arranged in said housing and a vibratory member for generating sound waves, a tube defining a resonant chamber having a proximal end attached to said housing and a distal end, and a partition arranged in said resonant chamber between said plurality of tone generating units and said distal end, said partition having an aperture for passage of said sound waves from said main sound wave emanating faces of said plurality of tone generating units to said resonant chamber.

10. An electric acoustic converter, comprising a tube defining a resonant chamber having a proximal end and a distal end, a tone generating unit arranged in said proximal end and having a vibratory member for generating sound waves and a main sound wave emanating face, and a partition arranged in said resonant chamber between said tone generating unit and said distal end, said partition arranged at a spaced distance from said tone generating unit and having an aperture for passage of said sound waves from said main sound wave emanating face of said tone generating unit to said resonant chamber.

11. An electric acoustic converter as claimed in claim 10 wherein said resonant chamber has a transverse cross-section which increases from said partition to said distal end.

12. An electric acoustic converter as claimed in claim 10 further comprising a housing disposed about said tone generating unit and a plurality of tubes each defining a resonant chamber having a proximal end attached to said housing and a distal end, and a partition arranged in each of said resonant chambers between said tone generating unit and said distal ends of said resonant chambers, said partitions arranged at spaced distances from said tone generating unit, each of said partitions having an aperture for passage of said sound waves from said main sound wave emanating face of said tone generating unit to each of said resonant chambers.

13. An electric acoustic convertor as claimed in claim 12 wherein one of said resonant chambers has a first length, and at least one other of said resonant chambers has a second length different from said first length.

14. An electric acoustic converter, comprising a housing, a tone generating unit having a main sound wave emanating face arranged in said housing and a vibratory member for generating sound waves, a plurality of tubes each defining a resonant chamber having a proximal end attached to said housing and a distal end, and a partition arranged in each of said resonant chambers between said tone generating unit and said distal ends of said resonant chambers, each of said partitions having an aperture for passage of said sound wave from said main sound wave emanating face of said tone generating unit to each of said resonant chambers, one of said resonant chambers having a first transverse cross-section, and at least one other of said resonant chambers having a second transverse cross-section different from said first transverse cross-section.

15. An electric acoustic convertor comprising, a tube defining a resonant chamber having a proximal end and a distal end, a tone generating unit arranged in said proximal end and having a vibratory member for generating sound waves and a main sound wave emanating face, and a partition arranged in said resonant chamber between said tone generating unit and said distal end and operatively connected to said tone generating unit to form a tone generating assembly longitudinally displaceable along said resonant chamber, said partition having an aperture for passage of said sound waves from said main sound wave emanating face of said tone generating unit to said resonant chamber.

* * * * *